US006109462A

United States Patent [19]

Emalfarb et al.

[11] Patent Number: 6,109,462

[45] Date of Patent: Aug. 29, 2000

[54] ARTICLE HANGER WITH VARIABLE RECEPTACLE CONFIGURATION

[76] Inventors: Bradley Emalfarb, 763 Bunker Ct.; Seymour Emalfarb, 1585 Saunders Rd., both of Riverwoods, Ill. 60015

[21] Appl. No.: 08/928,411

[22] Filed: Sep. 12, 1997

Related U.S. Application Data

[63] Continuation-in-part of application No. 08/911,610, Aug. 15, 1997.

[51] Int. Cl.[7] ..... A47F 5/13

[52] U.S. Cl. ..... 211/119; 211/181.1

[58] Field of Search ..... 211/85.31, 106, 211/119, 133.5, 181.1

[56] References Cited

U.S. PATENT DOCUMENTS

| | | | |
|---|---|---|---|
| 3,998,170 | 12/1976 | Gordon | 211/181.1 X |
| 4,178,844 | 12/1979 | Ward et al. | 211/182 X |
| 4,318,487 | 3/1982 | McCarthy | 211/134 |
| 5,181,621 | 1/1993 | Plaehn | 211/181 |
| 5,197,609 | 3/1993 | Siegel | 211/119 X |
| 5,390,443 | 2/1995 | Emalfarb et al. | 211/119 X |
| 5,582,302 | 12/1996 | Kozak | 211/181 X |
| 5,588,543 | 12/1996 | Finger | 211/119 X |
| 5,638,742 | 6/1997 | Kassasseya | 211/181.1 X |
| 5,645,182 | 7/1997 | Miller, Jr. et al. | 211/134 |
| 5,673,611 | 10/1997 | Tieman | 211/181.1 X |

*Primary Examiner*—Daniel P. Stodola

*Attorney, Agent, or Firm*—Wood, Phillips, Van Santen, Clark & Mortimer

[57] ABSTRACT

An article hanger having a frame made from formed wire elements defining a bottom wall to support an article and a peripheral wall projecting upwardly from the bottom wall, with the bottom wall and peripheral wall cooperatively defining an upwardly opening receptacle for an article. The frame has a front and rear, a top and bottom, and laterally spaced sides. The receptacle has a width between the sides of the frame. The frame has laterally spaced first and second sections, each defining a part of the bottom wall and the peripheral wall. The first and second frame sections are relatively repositionable between a) a first relative position wherein the receptacle has a first width and b) a second relative position wherein the receptacle has a second width that is different than the first width. There are cooperating first and second surfaces, one each on the first and second frame sections, which confront each other with the frame sections in the first relative position to maintain the first and second frame sections consistently in the first relative position. Third and fourth surfaces, one each on the first and second frame sections, confront each other with the frame sections in the second relative position to maintain the first and second frame sections consistently in the second relative position.

19 Claims, 8 Drawing Sheets

FIG. 7
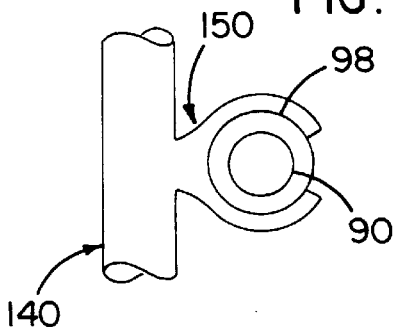
FIG. 8
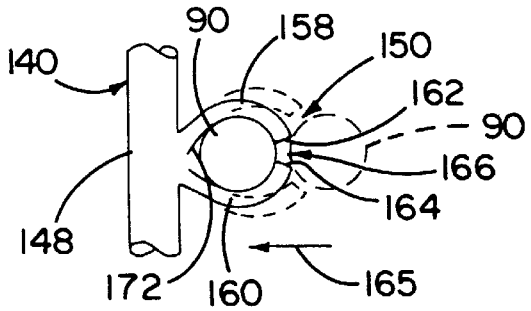
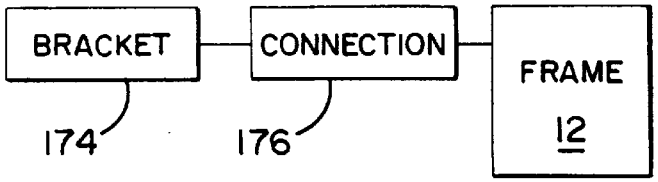
FIG. 9
FIG. 6
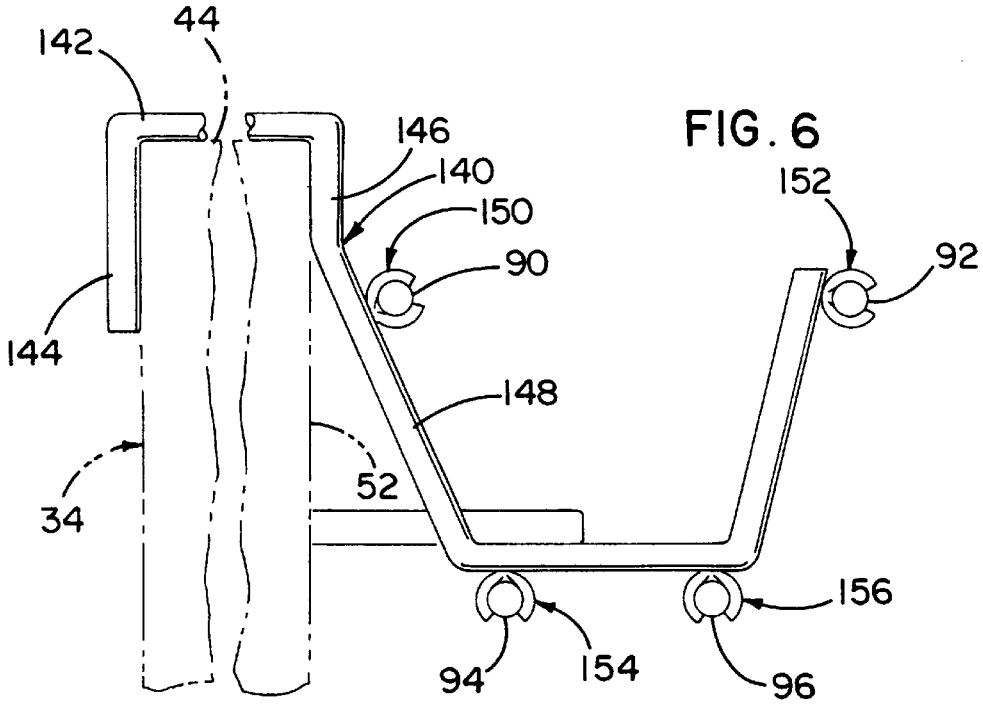

ARTICLE HANGER WITH VARIABLE RECEPTACLE CONFIGURATION

CROSS REFERENCE

This application is a continuation-in-part of co-pending application Ser. No. 08/911,610 filed Aug. 15, 1997, entitled "Article Hanger With Variable Receptacle Configuration".

BACKGROUND OF THE INVENTION

1. Field of the Invention

This invention relates to hangers of the type having a receptacle for an article, such as a pot for foliage, which hanger can be suspended from an upright support element, such as an upright post and/or rail.

2. Background Art

There has been a growing trend towards decorating around private homes, commercial buildings, apartments, and condominiums using hanging, potted plants. This concept is particularly popular around pool and patio decks. This type of hanger comes in a variety of different styles, ranging from a simple string-type cradle for the pots to more elaborate formed wire hangers which straddle, and are supported on, an upper edge of a support element, such as an upright post and/or a horizontally extending rail.

One commercially successful hanger design of the latter type is show in U.S. Pat. No. 5,390,443. In that patent, various configurations of hanger are shown, each defined by formed and welded, plastic-coated wire. Each of these hangers has a frame defining the receptacle and an integrally formed bracket, defining in conjunction with the frame, an inverted, U-shaped seat, with one leg and the base of the "U" defined by the bracket, and the other leg of the "U" defined by the frame. In a display position, the base of the "U" bears upon an upwardly facing surface of a support element, with the legs of the "U" each confronting one oppositely facing vertical surface on the support element.

This fixed construction, while highly commercially successful, has a number of inherent drawbacks. First of all, each bracket is configured to optimally cooperate with a single predetermined width for the support element surface. Since the surface of the support element may have a nominal width of 2 inches, 4 inches, 6 inches, 8 inches, 10 inches, etc., hangers with a wide range of bracket widths must be kept on hand to meet customer needs.

By reason of the receptacle size being fixed, the purveyor of these article hangers may also be required to keep on hand a large volume of article hangers having frames defining a significant range of different receptacle sizes. As the number of available bracket sizes and receptacle sizes increase, the potential combinations of these features that may be desired by the consumer increase dramatically. The purveyor thus has the option of keeping on hand a wide range of different hanger configurations or special ordering on a demand basis. The latter is not practical in that these hangers are generally relatively low cost items which may be considered "impulse" purchase items. Consumers are unlikely to wait any significant period of time for a special order and as a consequence sales may be lost by reason of not having the desired hanger configuration in stock.

Stocking the wide range of available configurations also has a number of drawbacks. A very significant problem with this type of hanger is that while the hangers are relatively light in weight, in an assembled state, the perimeter volume thereof is quite large. Individual boxing of the hangers often produces a bulky shape that takes up valuable warehouse and display space in the stores. Additionally, these boxes become difficult and oft times expensive to ship.

A further problem with keeping on hand so many different configurations of hanger is that stock control is complicated. A reasonable inventory may require the assigning of a relatively large number of SKU numbers.

From a manufacturing standpoint, dedicated lines, or diversions from lines, may be required to make the multiple different configurations for the hangers. This may add to the ultimate cost to the end user.

A further problem with the fixed configuration is that the consumer, after purchase, may determine that the purchased configuration is inappropriate, necessitating a return. This may only be discovered after an attempted setup. Returns are an obvious inconvenience to any business.

A number of the above problems have been overcome by the invention disclosed in U.S. Pat. No. 5,711,502, entitled "Article Hanger". The invention therein concerns a variable bracket configuration which permits a universal bracket construction for a wide range of bracket capacities.

However, while the bracket configuration may be varied, the receptacle size defined by the frame is fixed. Thus, assuming different receptacle capacity is desired, the purveyor employing the variable bracket configuration must nonetheless keep on hand hangers with a number of different frame configurations, thus forcing the manufacturer and purveyors to contend with the problems noted above.

SUMMARY OF THE INVENTION

In one form of the invention, an article hanger is provided having a frame made from formed wire elements defining a bottom wall to support an article and a peripheral wall projecting upwardly from the bottom wall, with the bottom wall and peripheral wall cooperatively defining an upwardly opening receptacle for an article. The frame has a front and rear, a top and bottom, and laterally spaced sides. The receptacle has a width between the sides of the frame. The frame has laterally spaced first and second sections, each defining a part of the bottom wall and the peripheral wall. The first and second frame sections are relatively repositionable between a) a first relative position wherein the receptacle has a first width and b) a second relative position wherein the receptacle has a second width that is different than the first width. There are cooperating first and second surfaces, one each on the first and second frame sections, which confront each other with the frame sections in the first relative position to maintain the first and second frame sections consistently in the first relative position. Third and fourth surfaces, one each on the first and second frame sections, confront each other with the frame sections in the second relative position to maintain the first and second frame sections consistently in the second relative position.

In one form, the first surface is defined on a repositionable leg on the first frame section and the repositionable leg is repositionable between a first position wherein the first and second surfaces confront each other and a second position wherein the first and second surfaces can move past each other as the first and second frame sections are moved relative to each other out of the first relative position.

The repositionable leg may be bendable to allow repositioning thereof between the first and second positions.

The repositionable leg may have a cantilever construction with a free end, with the first surface being adjacent to the free end.

The repositionable leg may have an elongate body with an offset portion extending transversely to the length of the elongate body, with the first surface being defined on the offset portion of the repositionable leg.

In one form, the first surface is on the first frame section and there is a fifth surface on the second frame section, with the first and fifth surfaces confronting each other with the frame sections in a third relative position to maintain the frame sections consistently in the third relative position.

The first frame section may have a unitary construction that is movable as one piece relative to the second frame section.

In one form, the first and second frame sections have cooperating telescoping elements which guide movement of the first and second sections between the first and second relative positions.

In one form, one of the first and second frame sections has a repositionable element and a cam surface, which cam surface engages the other of the first and second frame sections and repositions the repositionable element as an incident of the first and second frame sections being moved relative to each other to allow the first and second surfaces to move past each other and the first and second frame sections to be moved from the second relative position into the first relative position.

The invention also contemplates an article hanger having a frame formed from wire elements defining a bottom wall to support an article and a peripheral wall projecting upwardly from the bottom wall and defining in conjunction with the bottom wall an upwardly opening receptacle for an article. The frame has a front and rear, a top and bottom, and laterally spaced sides. The receptacle has a width between the sides of the frame, a depth between the front and rear of the frame, and a height between the bottom and the top of the frame. The frame has a plurality of relatively movable sections which cooperatively bound the receptacle. First and second of the frame sections are relatively repositionable between a) a first relative position wherein the receptacle has a first width, a first depth, and a first height and b) a second relative position wherein at least one of the width, depth, and height of the receptacle is different than the first width, first depth and first height. There are cooperating first and second surfaces, one each on two of the frame sections, which confront each other with the frame sections in the first relative position to maintain the first and second frame sections consistently in the first relative position. There are third and fourth surfaces, one each on two of the frame sections, which confront each other with the frame sections in the second relative position to maintain the first and second frame sections consistently in the second relative position.

In one form, the first frame section has a repositionable element with a cam surface thereon and the cam surface engages the second frame section as the first frame section is moved in a first direction relative to the second frame section and causes the repositionable element to reposition from a first position into a second position. With the repositionable element in the second position, the first and second surfaces are movable past each other to allow the first and second frame sections to realize the first relative position, whereupon the repositionable element is movable back into the first position so that the first and second surfaces confront each other to prevent the first frame section from moving oppositely to the first direction relative to the second frame section.

BRIEF DESCRIPTION OF THE DRAWINGS

FIG. 6 is a view as in FIG. 5 of a modified form of make-up bracket, according to the present invention;

FIG. 7 is an enlarged, fragmentary, side elevation view of a snap-fit connection between the bracket of FIG. 6 and the frame;

FIG. 8 is a view as in FIG. 7 with the frame being press fit into the connector;

FIG. 9 is a schematic representation of a hanger, according to the invention;

DETAILED DESCRIPTION OF THE DRAWINGS

Figure 1:
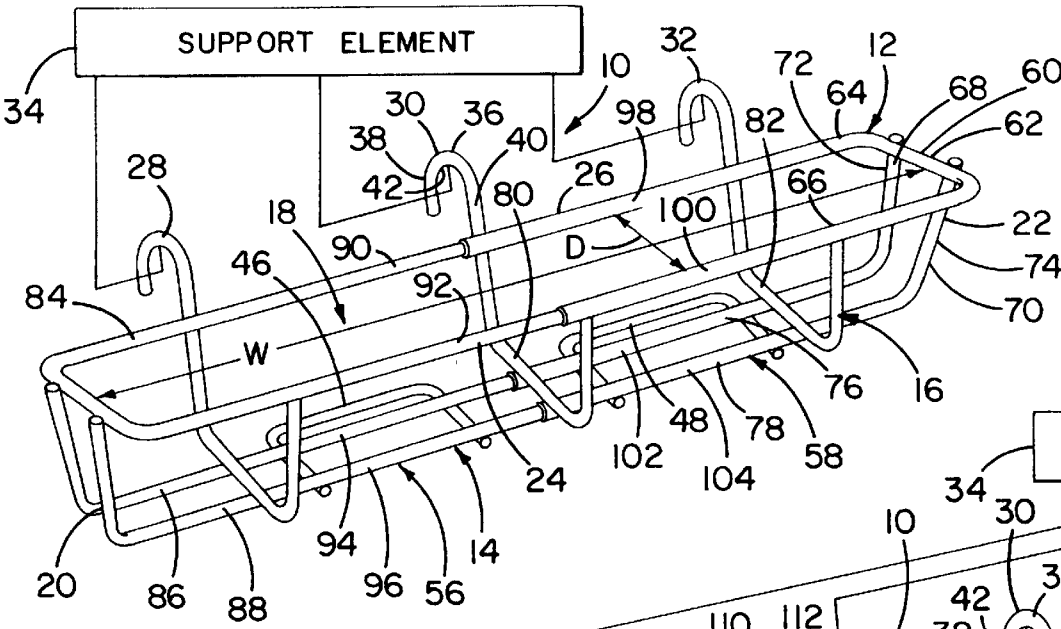
FIG. 1 is a perspective view of an article hanger, according to the present invention, having relatively movable frame sections which are in a first relative position to define a receptacle having a first dimension.
Figure 2:
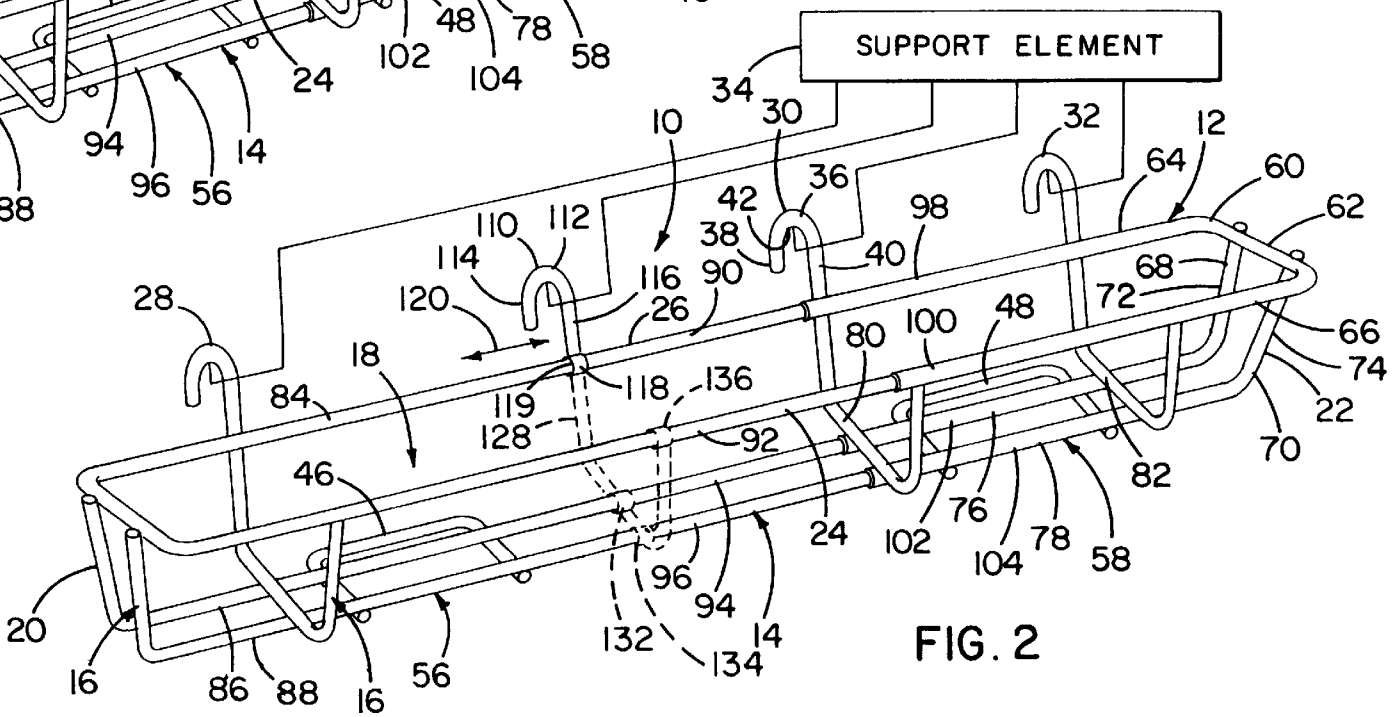
FIG. 2 is a view as in FIG. 1 with the frame sections relatively repositioned to define a second receptacle dimension.

Referring initially to FIGS. 1 and 2, an article hanger, according to the present invention, is shown at 10. The hanger 10 can be used to support virtually any type of article and is particularly desirable for use in conjunction with potted and unpotted foliage. The basic structure and function of the article hanger 10 are shown and described in detail in U.S. Pat. No. 5,390,443, incorporated herein by reference.

Briefly, the hanger 10 has a frame 12 defined by a plurality of formed wire members/elements. The wire elements may have a metal core which facilitate welding together of the wire elements. The wire elements may be conventionally plastic or rubber coated. The frame 12 has a bottom wall 14 defining an upwardly facing surface to support an article and a peripheral wall structure 16 extending upwardly from the bottom wall 14 and defining in conjunction therewith a receptacle 18 for an article to be displayed. The receptacle has a width W between laterally spaced side walls 20, 22, and a depth D between front and rear walls 24, 26, respectively.

Laterally spaced brackets 28, 30, 32 are mounted on the frame 12 and operatively engage a support element 34 to maintain the article hanger 10 in a display position, as show in FIG. 6. More specifically, the exemplary bracket 30 has an inverted "U" shape with a base 36 and legs 38, 40 projecting from the base 36. The base 36 defines a downwardly facing surface 42 projection to rearwardly of the frame 12 for bearing on an upwardly facing surface 44 (FIG. 6) of the support element 34 with the hanger 10 in the display position. In the display position, U-shaped bumpers 46, 48 abut to a forwardly facing surface 52 (FIG. 6) on the support element 34 to maintain the frame 12 in a desired orientation in its display position.

According to the invention, the frame 12 is defined by relatively repositionable sections 56, 58. The frame section 58 has an upper, U-shaped, hollow wire element 60 with a base 62 and spaced, laterally projecting legs 64, 66. The wire element 60 bounds an upper opening to the receptacle 18. L-shaped, hollow wire elements 68, 70 have vertically extending legs 72, 74 connected to the base 62 of the wire element 60 and legs 76, 78, projecting laterally away from the legs 72, 74 substantially parallel to each other and the legs 64, 66. The legs 72, 74 define the frame side wall 22 with the legs 76, 78 defining part of the frame bottom wall 14. The bumper 48 connects to and maintains the spacing of the legs 76, 78 at a location remote from the side wall 22.

The leg 40 of the bracket 30 blends into a frame extension 80 that is connected to each of the legs 76, 78 on the bottom wall 14 and projects upwardly to connect to the wire element 60 to define a part of the front wall 24. The bracket leg 40 is rigidly connected to the wire element 60.

The bracket 32 and a frame extension 82 therefrom are connected in like fashion to the wire elements 60, 68, 70 at a location between the bracket 30 and the side wall 22.

The frame section 56 is generally a mirror image of the frame section 58 with wire elements 84, 86, 88 corresponding consecutively to the wire elements 60, 68, 70. The wire elements 84, 86, 88 have laterally extending portions 90, 92, 94, 96 dimensioned to fit within alignable, laterally extending portions 98, 100, 102, 104 on the hollow wire elements 60, 68, 70. With this arrangement, the "male" wire portions 90, 92, 94, 96 telescope within the wire portions 98, 100, 102, 104 to guide relative siding movement between the frame sections 56, 58 between a first position, shown in FIG. 1, and a second position, shown in FIG. 2. In FIG. 2, the width W of the receptacle 18 is increased by the amount of withdrawal of the wire portions 90, 92, 94, 96 from the wire portions 98, 100, 102, 104 starting from the first, FIG. 1 position.

In a preferred form, the wire sections 56, 58 are fully separable from each other by continuing to move the wire portions 90, 92, 94, 96 laterally out of the wire portions 98, 100, 102, 104. This permits stacking of the frame sections 56, 58 and thus more compact relative placement thereof for display and packaging.

Figure 3:
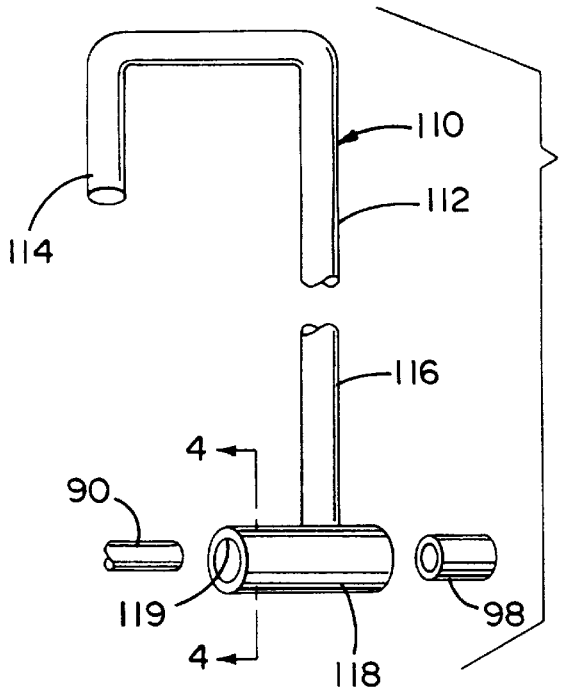
FIG. 3 is an enlarged, exploded, fragmentary, perspective view of a repositionable make-up bracket, according to the invention ad in relationship to a part of the frame, for supporting and maintaining the article hanger in a display position upon a support element.
Figure 4:
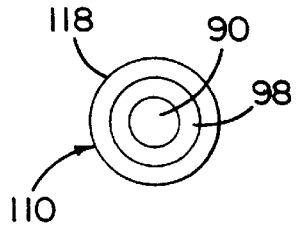
FIG. 4 is a cross-sectional view of the bracket and frame taken along line 4—4.

In the embodiment shown, the brackets 28, 30, 32 are rigidly connected to their associated frame sections 56, 58. In the first relative position of FIG. 1, the hanger 30 is, for purposes of balance, located approximately midway between the brackets 28, 32. As the frame sections 56, 58 are relatively moved from the first relative position into the second relative position of FIG. 2, there develops a substantial space between the brackets 28, 30 which is unsupported. To address this situation, a make-up bracket 110 is provided, as shown in FIGS. 2–4.

The bracket 110 has an inverted, U-shaped body 112 with spaced legs 114, 116. The leg 116 has attached thereto a cylindrical slider element 118. The slider element 118 has a through bore 119 to guidingly accept the wire portion 90. With this arrangement, the bracket 110 is slidable laterally in the direction of the double-headed arrow 120 along the wire portion 90 to be situated where desired to provide an optimum support location. The bore 119 can be dimensioned to accept the hollow wire portion 98 so that the bracket 110 is selectively repositionable anywhere between the brackets 28, 30.

Figure 5:
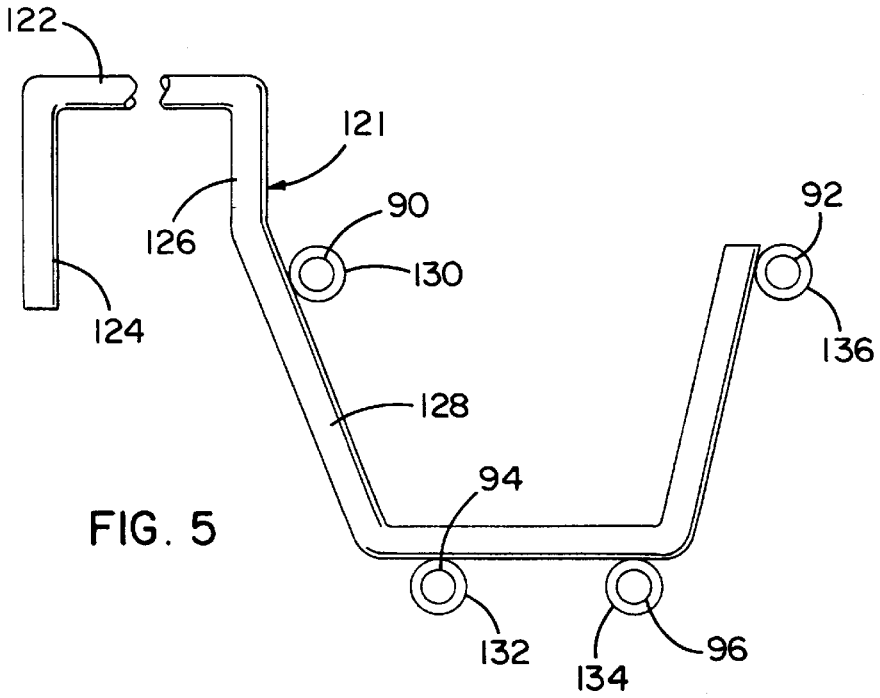
FIG. 5 is an enlarged, fragmentary, side elevation view of a modified form of make-up bracket, according to the invention and operatively connected to the frame in FIGS. 1 and 2.
Figure 10:
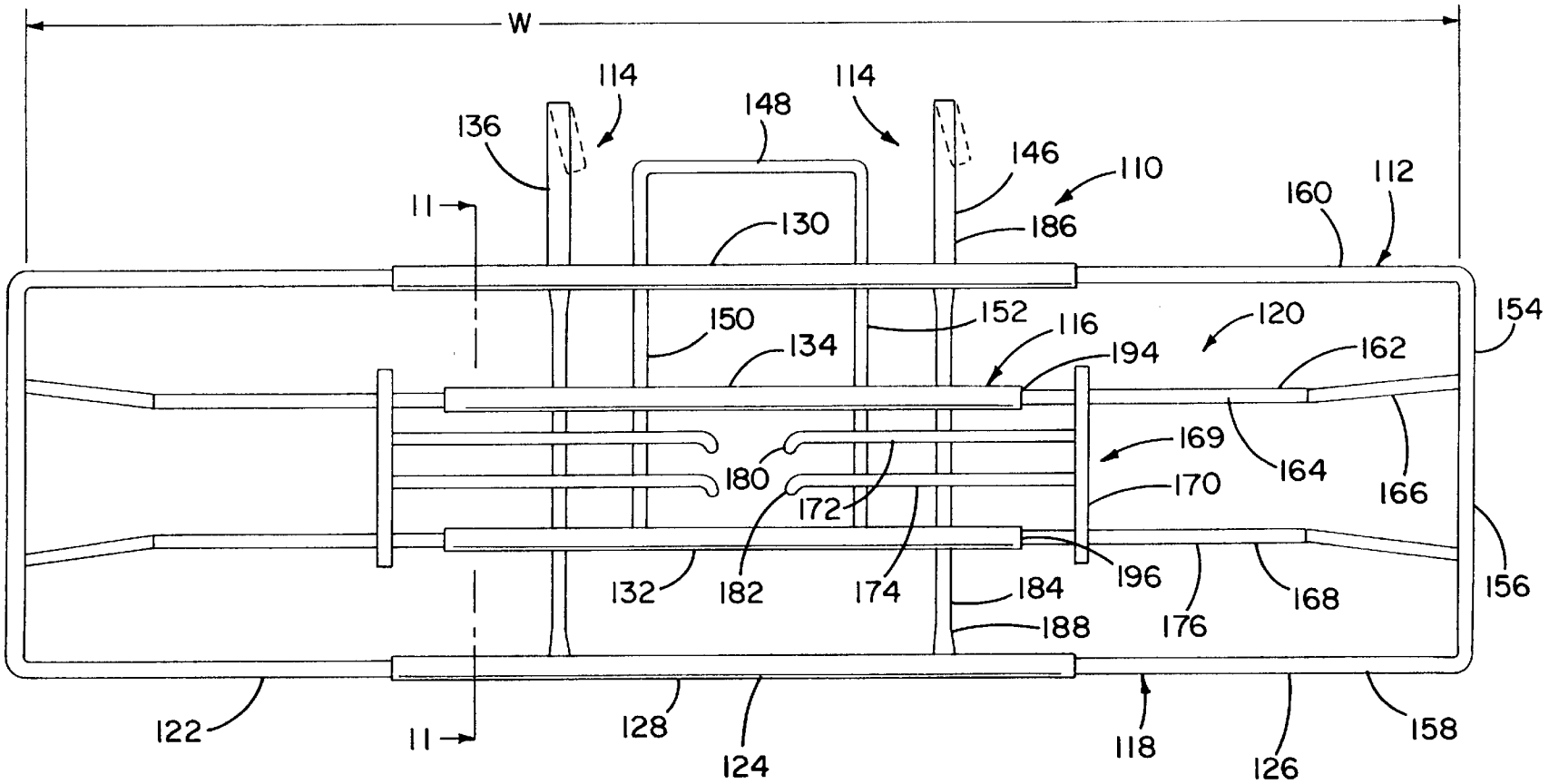
FIG. 10 is a plan view of a modified form of article hanger, according to the present invention, and with relatively movable frame sections thereon in a first relative position.
Figure 11:
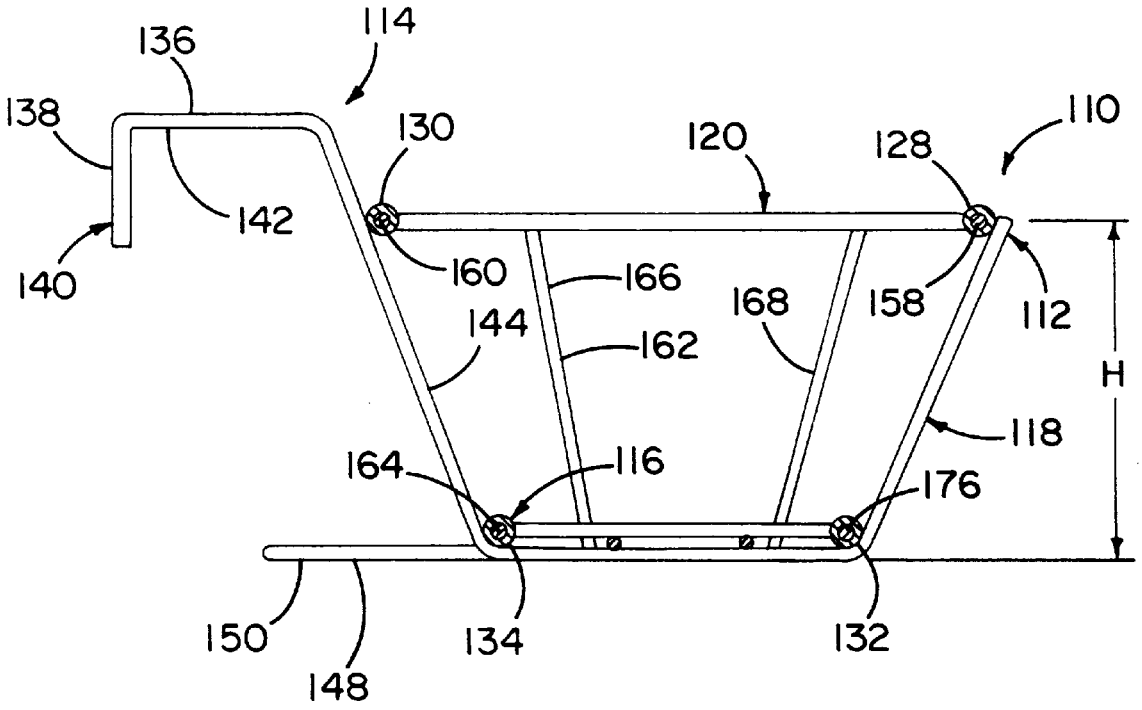
FIG. 11 is a cross-sectional view of the article hanger taken along line 11—11 of FIG. 10.
Figure 12:
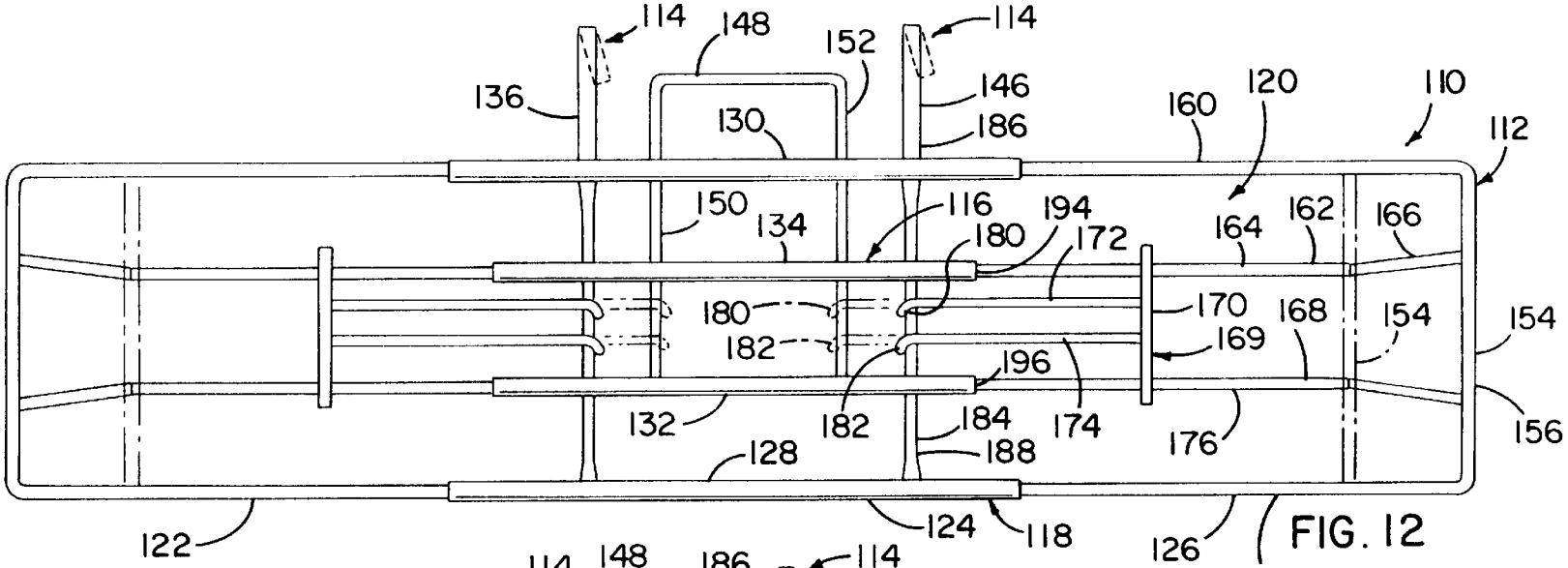
FIG. 12 is a plan view of the article hanger in FIGS. 10 and 11 with the frame sections in a second relative position.
Figure 13:
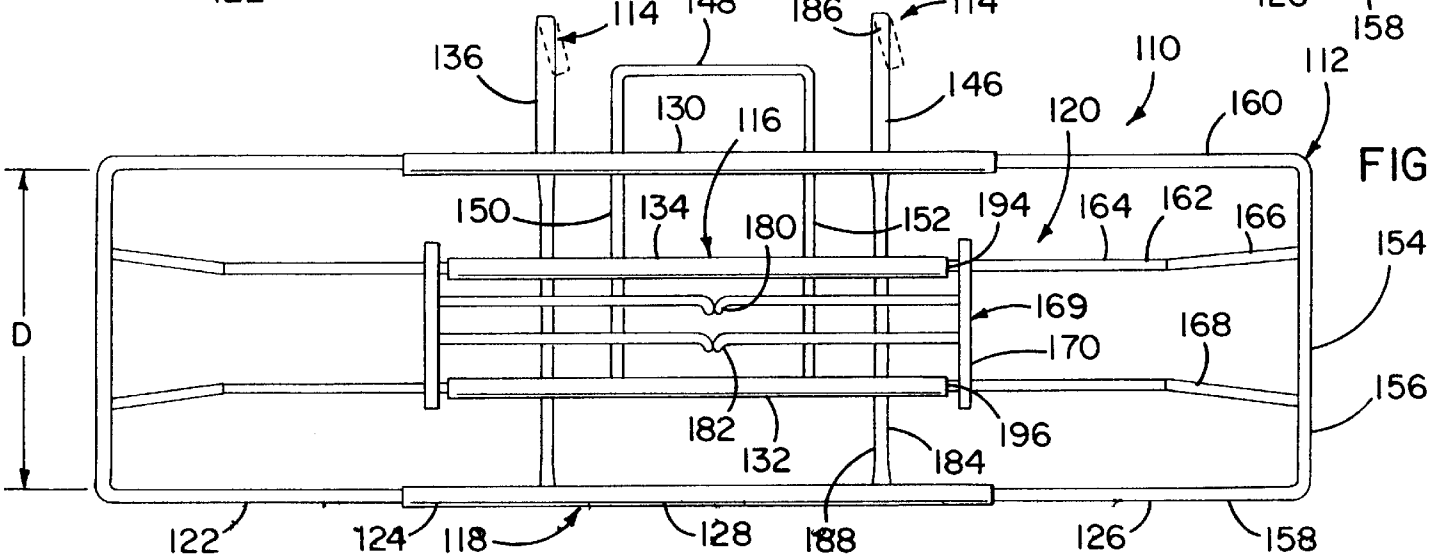
FIG. 13 is a view as in FIG. 12 with the frame sections in a third relative position.
Figure 14:
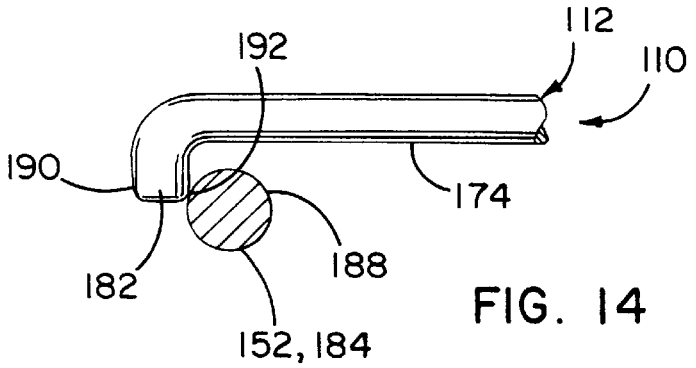
FIGS. 14–16 are enlarged, fragmentary, partial cross-sectional views showing the relationship between a repositionable element on one of the frame sections interacting with another of the frame sections as the relative position of the two frame sections is changed.

In FIG. 5 and in phantom lines in FIG. 2, a modified form of make-up bracket is shown at 121. The bracket 120 has an inverted, U-shaped body 122 with spaced legs 124, 126. The leg 126 has a frame extension 128 which extends behind the wire portion 90, over the wire portions 94, 96 and behind the wire portion 92. Wire elements 130, 132, 134, 136 are attached to the frame extension 128 and slidingly receive the wire portions 90, 92, 94, 96. With this arrangement, the bracket 121 is slidable laterally guidingly along the frame section 56 and at the same time provides reinforcement between the wire portions 90, 92, 94, 96.

In FIGS. 6–8, a further modified form of make-up bracket is shown at 140. The make-up bracket 140 has an inverted, U-shaped body 142 with spaced legs 144, 146. The leg 146 has a frame extension 148 which extends behind the wire portion 90, over the wire portions 94, 96 and behind the wire portion 92. The frame extension 148 has snap connectors 150, 152, 154, 156 which frictionally snap connect to the wire portions 90, 92, 94, 96.

In FIG. 8, exemplary snap connector 150 is shown. The snap connector 150 has cantilevered, spaced, curved legs 158, 160 projecting from the frame extension 148. The leg 158 has a free end 162, with the leg 160 having a like free end 164 between which an entry opening 166 is defined. The wire portion 90 can be directed against the free ends 162, 164 of the legs 158, 160. Pressure application in the direction of the arrow 165 causes the free ends 162, 164 to cam away from each other to enlarge the entry opening 166 to allow the wire portion 90 to eventually seat in a receptacle 172 formed cooperatively by the legs 158, 160. With the wire portion 90 fully seated, the legs 158, 160 spring back towards an undeformed state to frictionally and captively hold the wire portion 90.

Whereas the brackets 110, 120 are assembled to the frame sections 56, 58 with the frame sections 56, 58 separated from each other, the bracket 140 can be assembled to the frame 12 with the frame sections 56, 58 in assembled relationship. That is, the bracket 140 can be reconfigured to align the snap connectors 150, 152, 154, 156 at the wire portions 90, 92 94, 96, at any desired lateral location, whereupon a pressing force effects seating. A gripping force produced by the snap connectors 150, 152, 154, 156 is preferably selected so that the bracket 140 can be shifted laterally relative to the assembled frame sections 56, 58.

In FIG. 7, the snap connector 150 is shown pressed over the hollow wire portion 98 on the frame part 58. Each of the snap connectors 150, 152, 154, 156 preferably can be snap fit to either of the frame sections 56, 58.

With the inventive arrangement, the user has the ability to select the desired dimensions for the receptacle 18 and to situate the supporting brackets in an optimally balancing position on the frame 12. All of the brackets can be made to be laterally movable relative to and/or separable from the frame 12. Accordingly, one universal construction can accommodate a wide range of receptacle sizes.

The invention also contemplates that adjustable brackets, shown generically at 174 in FIG. 9, be attached through a connection 176 to the frame 12 so that the width of the inverted, U-shaped seat defined by the bracket 174 can be varied. A suitable type of bracket 174 for this purpose is shown in U.S. Pat. No. 5,711,502, the disclosure of which is incorporated herein by reference.

DESCRIPTION OF THE PREFERRED EMBODIMENT

A preferred form of article hanger, according to the present invention, is shown at 110 in FIGS. 10–17. As in the prior embodiments, the article hanger 110 has a frame 112, defined by formed wire elements, and a bracket assembly 114 for maintaining the article hanger 110 in the display position, corresponding to that shown in FIG. 6. The frame 112 has a bottom wall 116 and a peripheral wall 118 with the bottom and peripheral walls cooperatively defining an upwardly opening receptacle 120 for an article to be displayed.

The frame 112 is defined by relatively repositionable frame sections 122, 124, 126. The frame section 124 is defined by upper, hollow wire elements 128, 130, at the front and rear of the frame 112, and lower, hollow wire elements 132, 134 at the front and rear of the bottom wall 116 of the frame 112. One bracket 136 on the bracket assembly 114 has a body 138 with a portion 140 projecting rearwardly of the frame 112 and defining an inverted, U-shaped receptacle 142. The body 138 has a frame portion 144 which abuts to the rear of the upper wire element 130, wraps under and around the wire elements 134, 132, and extends upwardly to abut to the front of the wire element 128. The body 138 is fixedly attached, as by welding, to each of the wire elements 130, 134, 132, 128. A laterally spaced bracket 146 on the bracket assembly 114 is similarly connected to the wire elements 128, 130, 132, 134 so that the brackets 136, 146 and wire elements 128, 130, 132, 134 define a unitary assembly.

A U-shaped, forwardly opening bumper element 148 has forwardly projecting, substantially parallel legs 150, 152, each attached to the underside of the wire elements 132, 134. The bumper element 148 serves the same function as the bumper elements, previously described.

The frame sections 122 ,126 have an identical construction. Exemplary frame section 126 has an upper, U-shaped wire element 154 with a base 156 defining one side of the frame 112, and spaced legs 158, 160 defining part of the front and rear of the frame 112. An L-shaped wire element 162 has a horizontal leg 164 and a leg 166 extending angularly upwardly from the leg 164 to the base 156. The leg 164 defines part of the bottom wall 116, with the leg 166 defining part of the peripheral wall 118. A like, L-shaped wire element 168 depends from the base 156 and is spaced forwardly from the wire element 162.

A T-shaped holding assembly 169 has a cross bar 170 and elongate legs 172, 174 projecting from the cross bar 170 in substantially parallel relationship to each other, the leg 164 on the wire element 162, and a corresponding leg 176 on the wire element 168. The leg 172 has a downwardly projecting offset 180 at its free end, with the leg 174 having a like offset 182 at its free end. The legs 172, 174 are supported in cantilever fashion from the cross bar 170 and are bendable at the free ends thereof slightly upwardly away from the bottom wall 116, for reasons that will be described hereinbelow.

The legs 158, 176, 164 and 160 are dimensioned to telescopingly mate with the wire elements 128, 132, 134, 130, consecutively. Through this arrangement, the frame section 126 can be translatingly moved from a position wherein it is fully separated from the frame section 124, to the FIG. 13 position. The legs 158, 176, 164, 160 and wire elements 128, 132, 134, 130 slidingly guide this relative lateral movement between the sections 124, 126.

Figure 15:
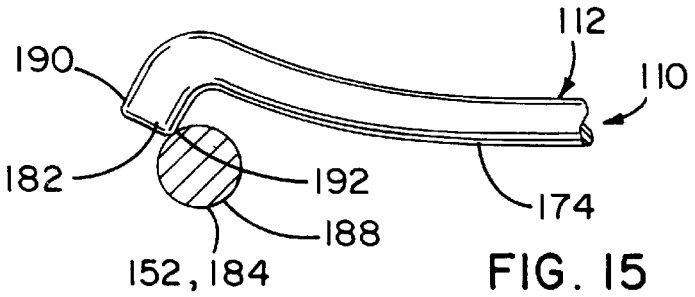
Figure 16:
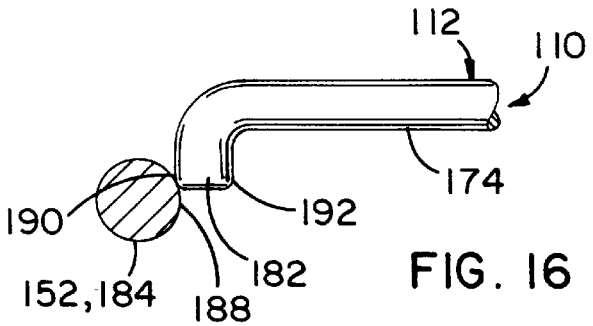
Figure 17:
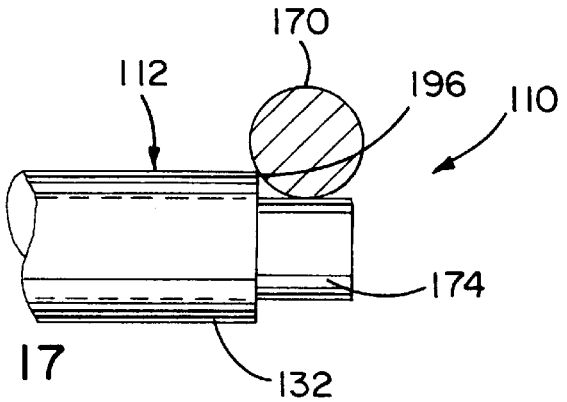
FIG. 17 is an enlarged, fragmentary, partial cross-sectional view of the frame sections with surfaces thereon abutting to maintain the frame sections in a predetermined relative position.

According to the invention, the holding assembly 169 interacts with the bracket 146, the bumper element 148, and the wire elements 132, 134 to releasably maintain the frame sections 124, 126 in each of three different relative positions. This interaction is seen in detail in FIGS. 14–17, with one exemplary leg 174. As the frame sections 124, 126 are operatively engaged and the frame section 126 is moved from right to left relative to the frame section 124, the offset 182 on the leg 174 initially contacts a leg 184 on a body 186 of the bracket 146. The leg 184 has a cylindrical outer surface 188 which is initially contacted by a laterally facing surface 190 on the offset 182 at an above center position on the surface 188. Continued lateral (right-to-left) movement of the frame section 126 from the FIG. 16 position causes the engaging surfaces 188, 190 to produce a camming action which tends to bend the leg 174 from a first, undeformed position, as shown in FIG. 16, upwardly to a second position, as shown in FIG. 15, to allow the offset 182 to ride over the leg 184. Upon the FIG. 14 position being realized, the surface 192 on the offset, facing laterally oppositely to the surface 190, is moved past the surface 188 and into laterally confronting relationship therewith. As a result, the frame sections 124, 126 are releasably maintained in the FIG. 12 position. That is, a left-to-right force on the frame section 126 in the FIG. 12 position is resisted by the interaction between the surfaces 188, 192.

As a left-to-right force on the frame section 126 is increased to a predetermined point, the surfaces 188, 192 interact to produce a camming force that causes the leg 174 to bend upwardly from the first position into the second position to of FIG. 15. After the leg 174 has been moved to the FIG. 16 position, the leg 174 springs back to an undeformed state i.e. into its first position.

The same interaction is contemplated between the leg 174 and the leg 152 on the bumper element 148. That is, the frame section 126 can be moved from the solid line position of FIG. 12 to the phantom line position in FIG. 12 in which the frame sections 124, 126 are in the second relative position.

Continued right-to-left movement of the frame section 126 ultimately causes the cross bar 170 to simultaneously abut to the lateral surfaces/edges 194, 196 on the elements 134, 132, respectively. As the cross bar 170 abuts to the elements 132, 134, the frame sections 124, 126 assume a third relative position.

The frame section 122 cooperates with the frame section 124 in the same manner as does the frame section 126. The assembled frame sections 122, 126 are mirror images of each other.

According to the invention, by varying the relative positions of the frame sections 122, 124, 126, the width W (FIG. 10) of the receptacle 120 can be selected by the end user. By joining and applying a lateral assembly pressure on the frame sections 122, 124, 126, the frame sections 122, 124, 126 can be placed in and maintained in a plurality of selected relative positions. In this particular embodiment, the entire article hanger 110 can be sold with three parts which can be readily interconnected by the end user.

The invention also contemplates that the depth D (FIG. 13) of the receptacle 120 and the height H (FIG. 11) of the receptacle 120 can be varied using the same inventive concept.

Figure 18:
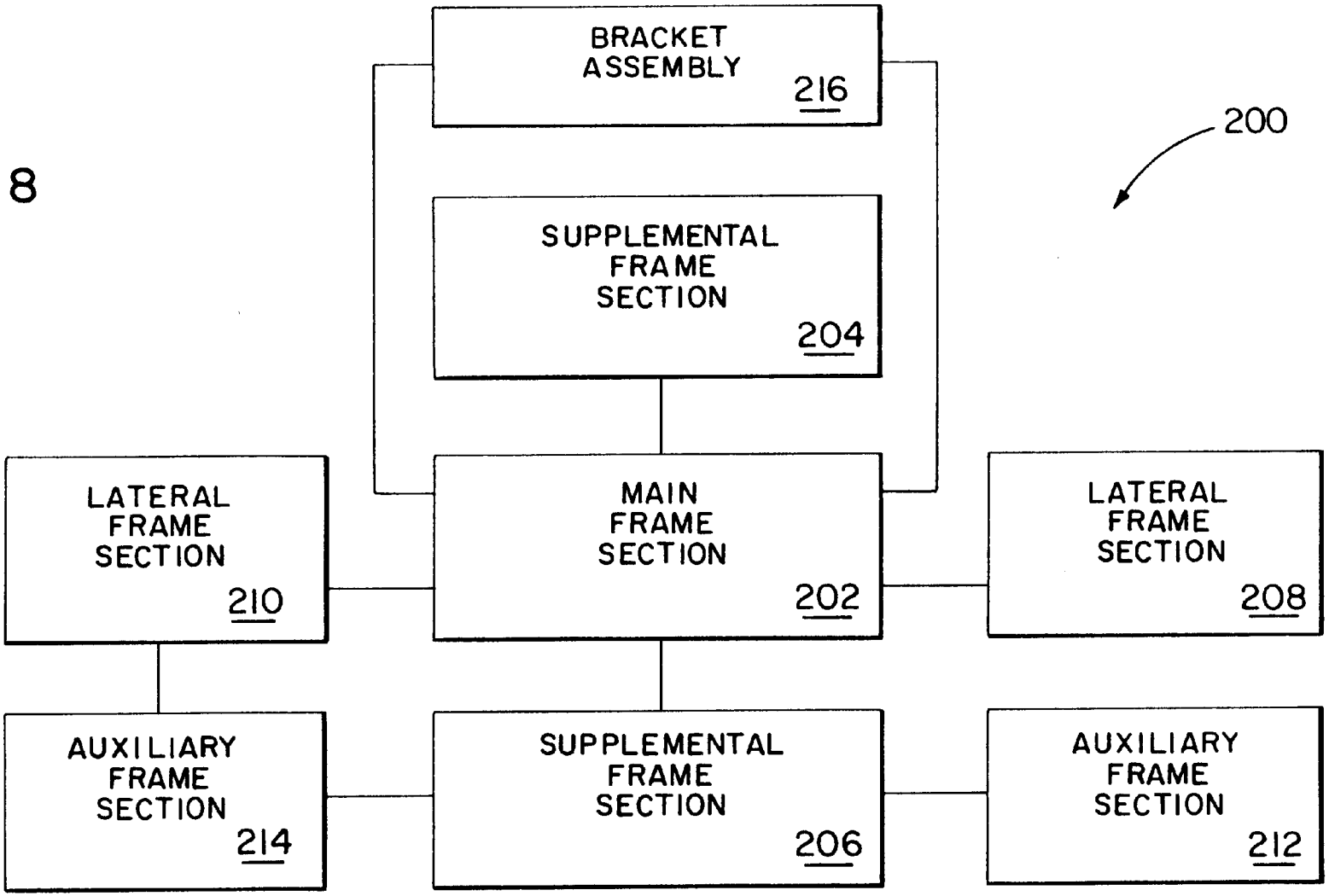
FIG. 18 is a schematic representation of an article hanger, according to the present invention.

A generic type article hanger, according to the invention, is shown at 200 in FIG. 18 with height, depth, and width adjustment capability. The article hanger 200 has a frame consisting of a main frame section 202, a supplemental frame section 204 which is repositionable relative to the main frame section 202 to vary the height H of the article hanger 200, and a supplemental frame section 206 which is repositionable relative to the main frame section 202 to vary the depth D of the receptacle defined by the article hanger 200. Lateral frame sections 208, 210 are repositionable relative to the main frame section 202 to selectively vary the width W of the receptacle defined by the article hanger 200. Auxiliary frame sections 212, 214 attach respectively to the lateral frame section 208 and supplemental frame section 206 and the lateral frame section 210 and supplemental frame section 206 to accommodate width and depth variation. A bracket assembly 216 attaches to at least the main frame section 202 to suspend the article hanger 200 from a suitable support. Using the inventive concept, various pieces can be snapped together to releasably maintain the receptacle in the article hanger 200 in any of a number of different configurations.

The foregoing disclosure of specific embodiments is intended to be illustrative of the broad concepts comprehended by the invention.

We claim:

1. An article hanger comprising:

a frame comprising formed wire elements with edges cooperatively defining a bottom wall to support an article and a peripheral wall projecting upwardly from the bottom wall and defining in conjunction with the bottom wall an upwardly opening receptacle for an article, which receptacle has a width between the sides of the frame and a volume, the frame having a front and rear, a top and bottom, and laterally spaced sides, the frame having laterally spaced first and second sections each defining a part of the bottom wall and the peripheral wall, the first and second frame sections being movable guidingly against and relative to a part of the frame along a first line and thereby relatively repositionable between a) a first relative position wherein the receptacle has a first width and first volume and b) a second relative position wherein the receptacle has a second width that is different than the first width and a second volume that is different than the first volume, there being cooperating first and second surfaces, one each on the first and second frame sections, which confront each other with the frame sections in the first relative position to releasably maintain the first and second frame sections consistently in the first relative position, there being third and fourth surfaces, one each on the first and second frame sections, which confront each other with the frame sections in the second relative position to releasably maintain the first and second frame sections consistently in the second relative position, the first and second frame sections being relatively guidingly movable along the first line from the first relative position to and beyond the second relative position to a third relative position wherein the receptacle has a third volume different than the first and second volumes.

2. The article hanger according to claim 1 wherein there is a repositionable leg on the first frame section, the first surface is defined on the repositionable leg and the repositionable leg can be repositioned from a first position wherein the first and second surfaces confront each other and a second position wherein the first and second surfaces can move past each other as the first and second frame sections are moved relative to each other out of the first relative position.

3. The article hanger according to claim 2 wherein the repositionable leg is bendable to allow repositioning of the repositionable leg from its first position into its second position.

4. The article hanger according to claim 1 wherein the first and second frame sections have cooperating telescoping elements which guide movement of the first and second sections between the first and second relative positions.

5. The article hanger according to claim 1 wherein one of the first and second frame sections has a repositionable element and a cam surface which cam surface engages the other of the first and second frame sections and repositions the repositionable element as an incident of the first and second frame sections being moved relative to each other and the first and second surfaces to move past each other to allow the first and second frame sections to be moved into the first relative position.

6. The article hanger according to claim 1 wherein the first surface is on the first frame section and there is a fifth surface on the second frame section and the first and fifth surfaces confront each other with the frame sections in a fourth relative position to maintain the frame sections consistently in the fourth relative position.

7. The article hanger according to claim 1 wherein the first frame section has a unitary construction and is movable as one piece relative to the second frame section.

8. An article hanger comprising:

a frame comprising formed wire elements defining a bottom wall to support an article and a peripheral wall projecting upwardly from the bottom wall and defining in conjunction with the bottom wall an upwardly opening receptacle for an article, which receptacle has a width between the sides of the frame, the frame having a front and rear, a top and bottom, and laterally spaced sides, the frame having laterally spaced first and second sections each defining a part of the bottom wall and the peripheral wall, the first and second frame sections being relatively repositionable between a) a first relative position wherein the receptacle has a first width and b) a second relative position wherein the receptacle has a second width that is different than the first width, there being cooperating first and second surfaces, one each on the first and second frame sections, which confront each other with the frame sections in the first relative position to maintain the first and second frame sections consistently in the first relative position, there being third and fourth surfaces, one each on the first and second frame sections, which confront each other with the frame sections in the second relative position to maintain the first and second frame sections consistently in the second relative position, wherein there is a repositionable leg on the first frame section, the first surface is defined on the repositionable leg and the repositionable leg can be repositioned from a first position wherein the first and second surfaces confront each other and a second position wherein the first and second surfaces can move past each other as the first and second frame sections are moved relative to each other out of the first relative position, wherein the repositionable leg has a cantilevered construction with a free end and the first surface is adjacent to the free end of the repositionable leg.

9. An article hanger comprising:

a frame comprising formed wire elements defining a bottom wall to support an article and a peripheral wall projecting upwardly from the bottom wall and defining in conjunction with the bottom wall an upwardly opening receptacle for an article, which receptacle has a width between the sides of the frame, the frame having a front and rear, a top and bottom, and laterally spaced sides, the frame having laterally spaced first and second sections each defining a part of the bottom wall and the peripheral wall, the first and second frame sections being relatively repositionable between a) a first relative position wherein the receptacle has a first width and b) a second relative position wherein the receptacle has a second width that is different than the first width, there being cooperating first and second surfaces, one each on the first and second frame sections, which confront each other with the frame sections in the first relative position to maintain the first and second frame sections consistently in the first relative position, there being third and fourth surfaces, one each on the first and second frame sections, which confront each other with the frame sections in the second relative position to maintain the first and second frame sections consistently in the second relative position, wherein there is a repositionable leg on the first frame section, the first surface is defined on the repositionable leg and the repositionable leg can be repositioned from a first position wherein the first and second surfaces confront each other and a second position wherein the first and second surfaces can move past each other as the first and second frame sections are moved relative to each other out of the first relative position, wherein the repositionable leg is bendable to allow repositioning of the repositionable leg from its first position into its second position, wherein the repositionable leg has an elongate body and an offset portion extending transversely to the length of the elongate body and the first surface is defined on the offset portion of the repositionable leg.

10. An article hanger comprising:

a frame comprising formed wire elements with edges cooperatively defining a bottom wall to support an article and a peripheral wall projecting upwardly from the bottom wall and defining in conjunction with the bottom wall an upwardly opening receptacle for an article, the frame having a front and rear, a top and bottom, and laterally spaced sides, the receptacle having a width between the sides of the frame, a height between the top and bottom of the frame, and a depth between the front and rear of the frame, the frame comprising a plurality of relatively movable sections which cooperatively bound the receptacle, there being first and second of the frame sections which are movable guidingly against and relative to a part of the frame and thereby relatively repositionable between a) a first relative position wherein the receptacle has a first width, a first depth, and a first height and b) a second relative position wherein the receptacle has a second width, a second depth, and a second height and at least one of the second width, second depth, and second height of the receptacle is different than the first width, the first depth, and first height, there being cooperating first and second surfaces, one each on the first and second frame sections, which confront each other with the frame sections in the first relative position to releasably maintain the first and second frame sections consistently in the first relative position, there being third and fourth surfaces, one each on the first and second frame sections, which confront each other with the frame sections in the second relative position to releasably maintain the first and second frame sections consistently in the second relative position, the first and second frame sections being relatively guidingly movable from the first relative position to and beyond the second relative position to a third relative position, wherein the receptacle has a third width, a third depth, and a third height and at least one of the third width, third depth, and third height is different than the fist and second widths, the first and second depths, and the first and second heights.

11. The article hanger according to claim 10 wherein the first frame section comprises a repositionable element with a cam surface thereon and the cam surface engages the second frame section as the first frame section is moved in a first direction relative to the second frame section and causes the repositionable element to reposition from a first position into a second position, with the repositionable element in its second position the first and second surfaces are movable past each other to allow the first and second frame sections to realize the first relative position, whereupon the repositionable element is movable back into its first position so that the first and second surfaces confront each other to prevent the first frame section from moving oppositely to the first direction relative to the second frame section.

12. The article hanger according to claim 11 wherein the repositionable element bends in changing between its first position and its second position.

13. The article hanger according to claim 10 wherein there is a repositionable leg on the first frame section, the first surface is defined on the repositionable leg on the first frame section and the repositionable leg can be repositioned from a first position wherein the first and second surfaces confront each other and a second position wherein the first and second surfaces can move past each other as the first and second frame sections are moved relative to each other out of the first relative position.

14. The article hanger according to claim 13 wherein the repositionable leg is bendable to allow repositioning of the repositionable leg from its first position into its second position.

15. The article hanger according to claim 10 wherein the first frame section has a unitary construction and is movable as one piece relative to the second frame section.

16. The article hanger according to claim 10 wherein the first and second frame sections have cooperating telescoping elements which guide movement of the first and second sections between the first and second relative positions.

17. The article hanger according to claim 10 wherein the first surface is on the first frame section and there is a fifth surface on the second frame section and the first and fifth surfaces confront each other with the frame sections in a third relative position to maintain the frame sections consistently in the third relative position.

18. An article hanger comprising:

a frame comprising formed wire elements defining a bottom wall to support an article and a peripheral wall projecting upwardly from the bottom wall and defining in conjunction with the bottom wall an upwardly opening receptacle for an article, the frame having a front and rear, a top and bottom, and laterally spaced sides, the receptacle having a width between the sides of the frame, a height between the top and bottom of the frame, and a depth between the front and rear of the frame, the frame comprising a plurality of relatively movable sections which cooperatively bound the receptacle, there being first and second of the frame sections which are relatively repositionable between a) a first relative position wherein the receptacle has a first width, a first depth, and a first height and b) a second relative position wherein at least one of the width, depth, and height of the receptacle is different than the first width, the first depth, and first height, there being cooperating first and second surfaces, one each on the first and second frame sections, which confront each other with the frame sections in the first relative position to maintain the first and second frame sections consistently in the first relative position, there being third and fourth surfaces, one each on the first and second frame sections, which confront each other with the frame sections in the second relative position to maintain the first and second frame sections consistently in the second relative position, wherein there is a repositionable leg on the first frame section, the first surface is defined on the repositionable leg and the repositionable leg can be repositioned from a first position wherein the first and second surfaces confront each other and a second position wherein the first and second surfaces can move past each other as the first and second frame sections are moved relative to each other out of the first relative position, wherein the repositionable leg has a cantilevered construction with a free end and the first surface is adjacent to the free end of the repositionable leg.

19. An article hanger comprising:

a frame comprising formed wire elements defining a bottom wall to support an article and a peripheral wall projecting upwardly from the bottom wall and defining in conjunction with the bottom wall an upwardly opening receptacle for an article, the frame having a front and rear, a top and bottom, and laterally spaced sides, the receptacle having a width between the sides of the frame, a height between the top and bottom of the frame, and a depth between the front and rear of the frame, the frame comprising a plurality of relatively movable sections which cooperatively bound the receptacle, there being first and second of the frame sections which are relatively repositionable between a) a first relative position wherein the receptacle has a first width, a first depth, and a first height and b) a second relative position wherein at least one of the width, depth, and height of the receptacle is different than the first width, the first depth, and first height, there being cooperating first and second surfaces, one each on the first and second frame sections, which confront each other with the frame sections in the first relative position, to maintain the first and second frame sections consistently in the first relative position, there being third and fourth surfaces, one each on the first and second frame sections, which confront each other with the frame sections in the second relative position to maintain the first and second frame sections consistently in the second relative position, wherein there is a repositionable leg on the first frame section, the first surface is defined on the repositionable leg and the repositionable leg can be repositioned from a first position wherein the first and second surfaces confront each other and a second position wherein the first and second surfaces can move past each other as the first and second frame sections are moved relative to each other out of the first relative position, wherein the repositionable leg is bendable to allow repositioning of the repositionable leg from its first position into its second position, wherein the repositionable leg has an elongate body and an offset portion extending transversely to the length of the elongate body and the first surface is defined on the offset portion of the repositionable leg.

* * * * *